US008800226B2

(12) United States Patent
Bloch

(10) Patent No.: US 8,800,226 B2
(45) Date of Patent: Aug. 12, 2014

(54) ELEVATOR SYSTEM HAVING A SHAFT-SIDE EXTINGUISHING WATER DRAIN SYSTEM

(75) Inventor: Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 13/517,456

(22) PCT Filed: Dec. 17, 2010

(86) PCT No.: PCT/EP2010/070131

§ 371 (c)(1),
(2), (4) Date: Jun. 20, 2012

(87) PCT Pub. No.: WO2011/085912

PCT Pub. Date: Jul. 21, 2011

(65) Prior Publication Data

US 2012/0266968 A1 Oct. 25, 2012

(30) Foreign Application Priority Data

Dec. 21, 2009 (EP) ..... 09180225

(51) Int. Cl.
*E04B 1/70* (2006.01)
*E04F 17/00* (2006.01)

(52) U.S. Cl.
USPC ..... 52/302.1; 52/16; 52/211; 49/471; 210/164

(58) Field of Classification Search
USPC ..... 52/302.1, 302.6, 211, 16, 58, 73, 169.5, 52/236.3, 11–15; 49/471; 210/163–165
See application file for complete search history.

(56) References Cited

U.S. PATENT DOCUMENTS

2005/0210768 A1* 9/2005 Lawson et al. ..... 52/97
2006/0230593 A1* 10/2006 Eggen et al. ..... 29/428
2008/0229676 A1* 9/2008 Allen ..... 52/58

FOREIGN PATENT DOCUMENTS

JP 52-115038 A 9/1977
JP 6-227773 A 8/1994
JP 10-324485 A 12/1998
JP 2005082363 A * 3/2005 ..... B66B 13/30
WO 98/22381 A1 5/1998

* cited by examiner

*Primary Examiner* — Brian Glessner
*Assistant Examiner* — Brian D Mattei
(74) *Attorney, Agent, or Firm* — Fraser Clemens Martin & Miller LLC; William J. Clemens

(57) ABSTRACT

A drain system, in an elevator system, is an open system wherein extinguishing water penetrating through a shaft door sill having bores meets a catch plate arranged underneath the shaft door sill and can be substantially discharged along at least one shaft wall.

11 Claims, 5 Drawing Sheets

State of the Art

ELEVATOR SYSTEM HAVING A SHAFT-SIDE EXTINGUISHING WATER DRAIN SYSTEM

FIELD

The present invention relates to an elevator installation in which at least one elevator car or at least one car and at least one counterweight are moved in opposite sense in an elevator shaft, wherein the at least one elevator car and the at least one counterweight run along guide rails and are supported by one or more supporting and driving means and driven by way of a drive pulley of a drive unit. The present invention relates to an extinguishing water drain system and particularly to the design of the elevator shaft.

BACKGROUND

Modern elevator installations or so-called fire service elevators, which are designed additionally for this purpose, have to ensure reliable operation even in the case of fire, on the one hand for evacuation of persons and/or material, which is at risk, from the floors affected by the fire and on the other hand also for the transport of fire service personnel and their extinguishing material. In both cases the use of extinguishing water—whether by means of a sprinkler installation or by the fire service or both—should not have the consequence that the elevator installation or the fire service elevator no longer functions.

This means that the electrical components of the elevator installation must remain dry. Moreover, it has to be ensured that the supporting and driving means do not become so wet that an uncontrollable slip arises between the drive pulley and the supporting and driving means. Slip can arise particularly easily, because the extinguishing water on the one hand can directly have a disadvantageous influence on the coefficients of friction between the drive pulley and the supporting and driving means or can change the viscosity of any lubricant present and on the other hand usually contains soap for improved combating of fire.

The slip occurring between drive pulley and supporting and driving means thus leads to a reduction of traction or even to a complete loss of traction of the elevator installation and—in the case of a significant difference between the weight of the elevator car and the weight of the counterweight—possibly to an uncontrolled travel of the elevator car, which has to be stopped by the safety brake thereof. The faultless functioning of the safety brake or the braking retardation of the brake shoes thereof on the guide rail can, however, in turn be guaranteed only if the brake shoes or the guide rail are not moistened by (soapy) extinguishing water.

All these preconditions make it necessary for the extinguishing water to be drained or collected in controlled manner. The extinguishing water normally penetrates via the shaft doors of the elevator shaft into the latter. International published specification WO 98/22381 A1 discloses an elevator installation with closed drainage system at the shaft doors as well as mechanically positively interengaging flow barriers at the sliding doors of each shaft door. In this way it is sought to keep the elevator shaft free from extinguishing water over its entire height at the outset by means of a closed outflow system. However, it is disadvantageous with this solution that each floor has to be equipped beforehand at high cost with appropriate drain pipes and the said flow barriers.

SUMMARY

It is an object of the present invention to provide an alternative solution to the protection—particularly of the or each supporting and driving means of the elevator installation—from the extinguishing water, which penetrates into the elevator shaft, with avoidance as far as possible of the above-mentioned disadvantage.

Fulfilment of this object consists in the first instance of arranging an open extinguishing water drain system not at the individual shaft doors, but in the elevator shaft. Open means in this connection that the extinguishing water is merely deflected, guided or fed to the critical points, namely to an extinguishing water drain system according to the invention with open sections at which in turn the extinguishing water can freely drip or flow away.

This basic inventive concept derives from recognition that the extinguishing water does not in principle have to be completely kept away from the elevator shaft, but can also flow away in controlled or guided manner into the elevator shaft. It was observed that extinguishing water which penetrates via the shaft doors into the elevator shaft is only a problem for the or each supporting and driving means to the extent that it drops down and atomises in uncontrolled manner because it impinges on obstacles or also only as a consequence of opposing air resistance.

Moreover, it was observed that a principle cause of the or each supporting and driving means becoming wet is the spraying or atomisation of the extinguishing water when impinging on the roof of the elevator car. Consequently, the open extinguishing water drain system, which is at the car side and which is described in the following, can be freely combined with an extinguishing water drain system at the car side, thus both extinguishing water drain systems can be used in an elevator installation in themselves separately, but also together without any additional inventive measures and thus provide further optimization of the overall drain system.

An extinguishing water drain system at the car side is thus distinguished by at least one drain plate arranged on the roof of the elevator car at an inclination to the horizontal. This drain plate can have one or more drain surfaces at different angles of inclination to the horizontal. The drain plate can also be formed from one or more adjustable roller blinds. The drain surfaces of the drain plate or the adjustable roller blind collect extinguishing water impinging on the roof of the elevator car and conduct it to a side surface of the elevator car or by means of channels to corners of the elevator car. A lip arranged at the side surface or outflow openings arranged at the channels in turn conduct the extinguishing water, which has collected on the roof of the elevator car, preferably to corresponding open intermediate spaces or receiving openings of the open extinguishing water drain system which is at the shaft side and described in the following.

A basic variant of a shaft-side extinguishing water drain system according to the invention in an elevator shaft thus provides an open construction by means of which extinguishing water which has already penetrated into the elevator shaft is collected at the outset.

An extinguishing water collector is provided at the underside of a respective shaft door as a first component of an extinguishing water drain system according to the invention at the shaft side. This extinguishing water collector basically consists of a collector plate which is arranged at the shaft wall below the shaft door at an angle of inclination to the vertical. The extinguishing water can be conducted away by the collector plate substantially along at least one shaft wall. This has the effect that the extinguishing water is largely prevented from wetting the car and, in particular, the supporting and driving means, which in turn permits use of the elevator notwithstanding extinguishing water penetrating into the shaft.

According to a first basic variant of this extinguishing water collector in the form of a collector plate an upper edge, which is at the shaft side, of the collector plate does not extend significantly further inwardly of the shaft than the sill of the shaft door. The sill of the shaft door is furnished with grooves and preferably additionally with bores or passage openings or recesses in the grooves between the groove webs and/or in the groove webs themselves so that the extinguishing water can flow through the shaft door sill with least possible hindrance. It is preferred to dispose the hole pattern of the bores so that more extinguishing water can flow through in the center of the shaft door sill than at the sides.

The extinguishing water collector will thus collect extinguishing water which flows through the shaft door sill. By contrast, extinguishing water which might arrive with pressure and in large quantity at the shaft door could spill over the shaft door sill and penetrate between the shaft door sill and the shaft door or doors or through the vertical gap between the sliding doors of the shaft door. According to the prior art, for example the cited International published specification WO 98/22381 A1 it is sought to prevent that by mechanically positive guides of the sliding doors in the shaft door sill as well as a mechanically positive closure edge of the sliding doors.

Lying within the scope of the disclosure of the present patent application is an optional variant of embodiment of the collector plate which protrudes by the upper edge thereof further into the shaft shaft than the shaft door sill and thus also collects extinguishing water flowing over the shaft door sill. Provision of sealing flow barriers can thus be redundant. However, the thereby-resulting spacing between the elevator car and the shaft door sill can be optionally bridged over by an automatic and motor-driven elevator car sill at the respective shaft door sill. The signal for movement of the elevator car sill up to the sill of the respective shaft door can in that regard be coupled with the opening signal of the shaft door or upstream thereof.

The collector plate can—whether flush with or protruding beyond the shaft door sills—be designed in accordance with the following variants:

a) Single-surface or double-surface with an approximately vertical part surface and an inclined part surface adjoining thereat, wherein the inclined part surfaces has an angle of inclination which can be in range of 10 to 80 degrees, but is preferably 45 degrees.

b) The lower edge, which is fastened to the shaft wall, of the collector plate is so arranged at the shaft wall that an intermediate space remains through which the extinguishing water is passed on exclusively to the shaft wall. The sides of the collector plate each have a respective upwardly drawn side plate so that no extinguishing water issues at the sides.

c) The collector plate is fastened by the lower edge thereof to the shaft wall like the variant under b) at a spacing from the shaft wall, but does not have side plates, so that the collected extinguishing water is conducted away not only through the intermediate space of the shaft wall, but also over the sides, preferably into the corners of the elevator shaft.

d) The lower edge, which is fastened to the shaft wall, of the collector plate is arranged flush with and tightly against the shaft wall. The material from which the collector plate is made is, however, apertured to be grid-like and thus allows throughflow of the collected extinguishing water principally to the shaft wall.

e) The collector plate is fastened flush with and tightly against the shaft wall by its lower edge, which is fastened to the shaft wall, like the variant under d), but does not have a grid structure with recesses, instead two tracks or surfaces in mirror image inclined downwardly approximately from the center of the collector plate. The sides are open and preferably have a spout at outflow openings, which conducts the extinguishing water to the corners of the elevator shaft.

The variants of embodiment of the collector plate which guide the extinguishing water away laterally preferably cooperate with a collector section arranged in the corners of the elevator shaft. This collector section can, in its simplest embodiment, be a sheet metal plate—grid-like or whole—mounted at the corner or, however, also a tube or only a C-shaped quarter-tube or a triangular section or a hose. All of these embodiments preferably have at the top a receiving opening widened in funnel shape. The collector profiles are arranged not continuously over the height of the elevator shaft, but merely as several collector section lengths mounted one below or above the other. In this way an open extinguishing water drain system at the shaft side arises, into which extinguishing water at any shaft door can be conducted, but equally also extinguishing water which is collected by the inclined roof construction of the elevator car.

Those variants of embodiment of the collector plate which conduct the extinguishing water approximately perpendicularly to the shaft wall are preferably combined with a drain plate which is preferably arranged at a door lintel of the next-lower shaft door. This drain plate is basically also arranged at an angle of inclination to the vertical. Analogously to the variants of embodiment of the collector plate arranged thereabove, the drain plate—with the same means or shapes described there—can also conduct the extinguishing water exclusively to the shaft wall or, in this case, to the shaft doors or exclusively to the sides or the collector sections in the corners of the elevator shaft or to both.

In the case of this last-mentioned variant of embodiment with a collector plate and a drain plate arranged thereunder a planar outflow plate improving the outflow of the extinguishing water is preferably arranged at the shaft wall between these two plates. Each outflow plate improves the outflow of the extinguishing water relative to the shaft wall just by its planar surface, but can also have a surface structure required for that purpose and/or be painted with a special paint, for example with a paint with lotus-flower effect, which forms a strongly water-repellent surface.

The collector plate, outflow plate and drain plate are respectively separately made as three individual parts or, however, also as a unitary plate section unifying all three plates, and preferably of sheet metal, but plastics material plates also come into consideration.

An extinguishing water drain system according to the invention at the shaft side or an elevator shaft has optional approximately vertically arranged slots in which approximately vertical cage drain plates, which are correspondingly arranged at the elevator car, as spray protection run in recessed manner so that also extinguishing water can no longer penetrate between a possible gap between the vertical cage drain plate and the opposing shaft wall.

An exemplifying elevator installation has, as an additional, optional technical measure for avoidance of a wet supporting and driving means, a respective stripper which is arranged at the two supporting and driving means sections below the drive pulley. These strippers are made of a flexible plastics material sliding on the surface of the supporting and driving means and completely enclose the cross-sectional circumference of the supporting and driving means. They are preferably oriented downwardly in frusto-conical or funnel-shaped manner so that depending on the respective running direction of the supporting and driving means or upward and downward movement of the elevator car always that supporting and driving means section in upward movement, thus towards the drive pulley, is stripped of extinguishing water adhering thereto.

A further variant of embodiment of an elevator installation provides a collecting device which collects the extinguishing water and when the elevator car moves past a trigger lever is unlatched or opened. This has the advantage that, firstly, the extinguishing water in certain circumstances does not drip in uncontrolled manner from the described plates and that, secondly, it is delivered with a gush—which is better controllable in its direction—to wherever desired. This can take place at a point of the elevator shaft which is additionally designed for receiving and conducting away the extinguishing water gush. The collecting devices is preferably equipped with a sensor which shows when the collecting device is full and travel of the elevator car past the trigger lever should take place.

The described individual features can be combined with one another to form an elevator installation, thus, for example, the different embodiments of the collector plate can be unified and combined with the different embodiments of the collector section and/or with the different embodiments of the drain plate as well as with the different embodiments of the elevator car to form an open extinguishing water drain system according to the invention.

Thus, an open extinguishing water drain system according to the invention is preferably characterized by the following functions:

- draining the extinguishing water at the sills of the shaft doors;
- collecting the drained extinguishing water by means of a collector plate;
- draining or feeding the collected extinguishing water by means of a drain plate into two open collector sections at two corners of the elevator shaft;
- draining or feeding extinguishing water, which is collected on the roof of the elevator car, similarly into the two open collecting sections at the two corners of the elevator shaft.

An elevator installation equipped in accordance with the invention brings the following advantages:

- extinguishing water penetrating through the shaft doors into the elevator shaft is kept away from the or each supporting and driving means;
- a reduction of the need for space of an elevator installation and a simplified capability of assembly by comparison with an elevator installation such as disclosed by the prior art and, for example, the above-cited International publication is achieved;
- existing elevator installation, regardless of whether without an engine room or with an engine room, can be retrofitted at any time with an open extinguishing water drain system according to the invention at the shaft side and/or with an extinguishing water drain system at the car side without the elevator shaft or the shaft doors having to be constructionally changed.

DESCRIPTION OF THE DRAWINGS

The invention is explained in more detail symbolically and by way of example on the basis of figures. The figures are described conjunctively and in general. The same reference numerals signify the same components and reference numerals with different indices indicate functionally equivalent or similar components.

In that case.

DETAILED DESCRIPTION

Figure 1:
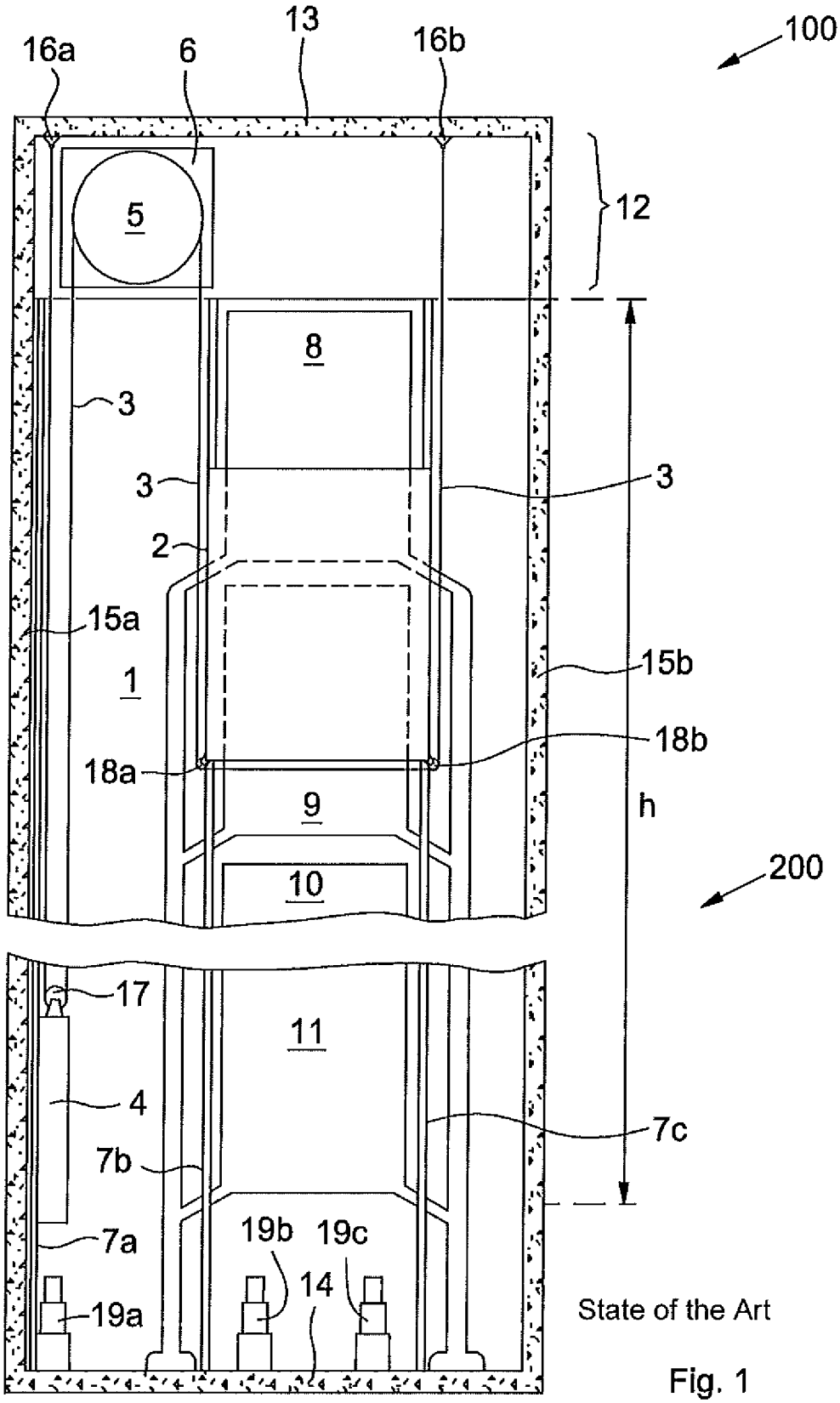
FIG. 1 shows a schematic illustration of an exemplifying elevator installation with an elevator shaft with an extinguishing water drain system according to the prior art.

FIG. 1 shows an elevator installation 100 such as is known from the prior art, for example in illustrated 2:1 suspension. An elevator car 2, which is connected with a movable counterweight 4 by way of a supporting and driving means 3, is movably arranged in an elevator shaft 1. The supporting and driving means 3 is, in operation, driven by means of a drive pulley 5 of a drive unit 6, which is arranged in the uppermost region of the elevator shaft 1 in an engine room 12. The elevator car 2 and the counterweight 4 are guided by means of guide rails 7*a* or 7*b* and 7*c* extending over the shaft height.

The elevator car 2 can serve, over a conveying height h, an uppermost floor door 8, further floor doors 9 and 10 and a lowermost floor door 11. The elevator shaft 1 is formed from shaft side walls 15*a* and 15*b*, a shaft ceiling 13 and a shaft floor 14, on which a shaft floor buffer 19*a* for the counterweight 4 and two shaft floor buffers 19*b* and 19*c* for the elevator car 2 are arranged.

The supporting and driving means 3 is fastened at a stationary fastening point or support means fixing point 16*a* to the shaft ceiling 13 and guided parallelly to the shaft side wall 15*a* to a support roller 17 for the counterweight 4. From here it goes back again over the drive pulley 5 to a first deflecting or support roller 18*a* and to a second deflecting or support roller 18*b*, loops under the elevator car 2 and on to a second stationary fastening point or support means fixing point 16*b* at the elevator shaft 13.

FIG. 1 also symbolically shows a closed extinguishing water drain system 200, which by means of closed pipe ducts and pipe connections conducts extinguishing water away from each individual floor or each individual shaft door 8-11 to the shaft floor 14.

Figure 2:
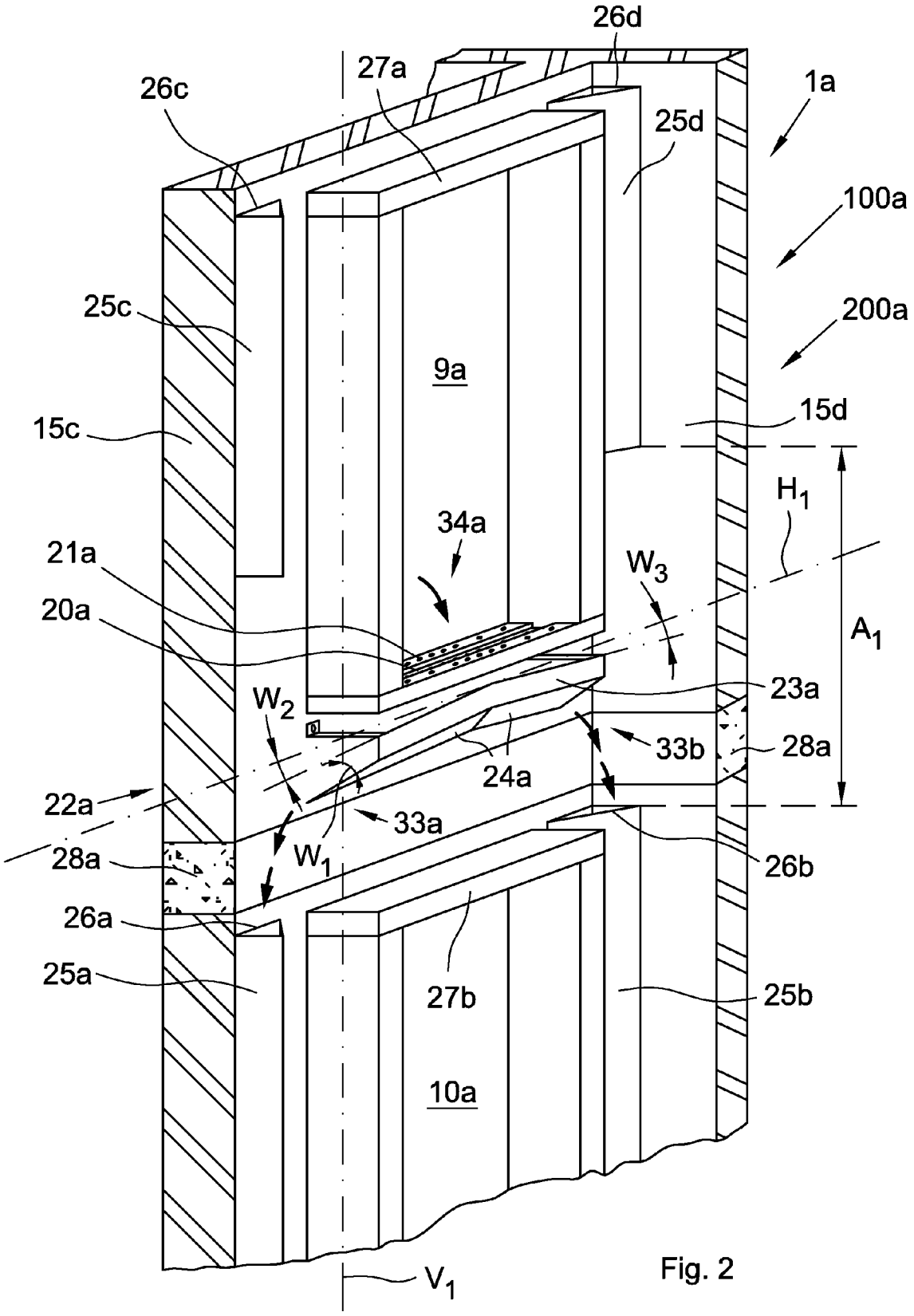
FIG. 2 shows a schematic illustration of a first variant of embodiment of an exemplifying elevator shaft or an exemplifying elevator installation with an extinguishing water drain system according to the invention at the shaft side.

FIG. 2 schematically shows a part of an exemplifying elevator shaft 1*a*, which is a component of an exemplifying elevator installation 100*a*. Of the side walls of the elevator shaft 1*a*, shaft side walls 15*c* and 15*d* are illustrated, which are arranged approximately at a right angle to one another. The floors are indicated by a storey floor or screed floor 28*a* and a respective floor door or shaft door 9*a* and 10*a* per floor is illustrated. A respective door lintel 27*a* and 27*b* is disposed at the upper side of the shaft doors 9*a* and 10*a*. Disposed at the lower side of the shaft door 9*a* is a shaft door sill 20*a* which consists of groove webs and has passage openings or recesses or bores 21*a* preferably not only in the groove webs, but also in the intermediate grooves. The bores 21*a* in this regard have a hole pattern which is narrower in the center of the shaft door sill 20*a* and wider towards the sides.

Arranged below the shaft door sill 20*a*, at the shaft side wall 15*c*, is a collector plate 22*a* which forms an approximately vertical—thus parallel to a vertical $V_1$—part surface 23*a* and a part surface 24*a* inclined at an angle of inclination $W_1$ to the vertical V. At least the inclined part surface 24*a* or, however, additionally also the approximately vertical part surface 23*a* forms or form in mirror image approximately from the center of the collector plate 22*a* a respective angle of inclination $W_2$ or $W_3$ to a horizontal $H_1$.

Consequently, as indicated by arrows, extinguishing water 34*a* flows through the shaft door sill 20*a*. The extinguishing water is collected by the collector plate 22*a* and is fed laterally through respective outflow openings 33*a* or 33*b* into receiving openings 26*a* or 26*b* respectively of a collector section 25*a* or 25*b*. For clarification of an open extinguishing water drain system 200*a* according to the invention further collector sections 25*c* and 25*d* with respective receiving openings 26*c* and 26*d* are arranged at a spacing $A_1$ and serve for reception of extinguishing water which would flow out of a shaft door above the shaft door 9*a*. The spacing $A_1$ is on the one hand decisive for reliable transfer of extinguishing water from the higher collector sections 25*c* and 25*d* into the lower collector sections 25*a* and 25*b* and on the other hand decisive for reliable reception of extinguishing water 34*a* from the outflow opening 33*a* and 33*b*, but also for a reliable reception of extinguishing water which has collected on the roof of the elevator car.

Figure 3:
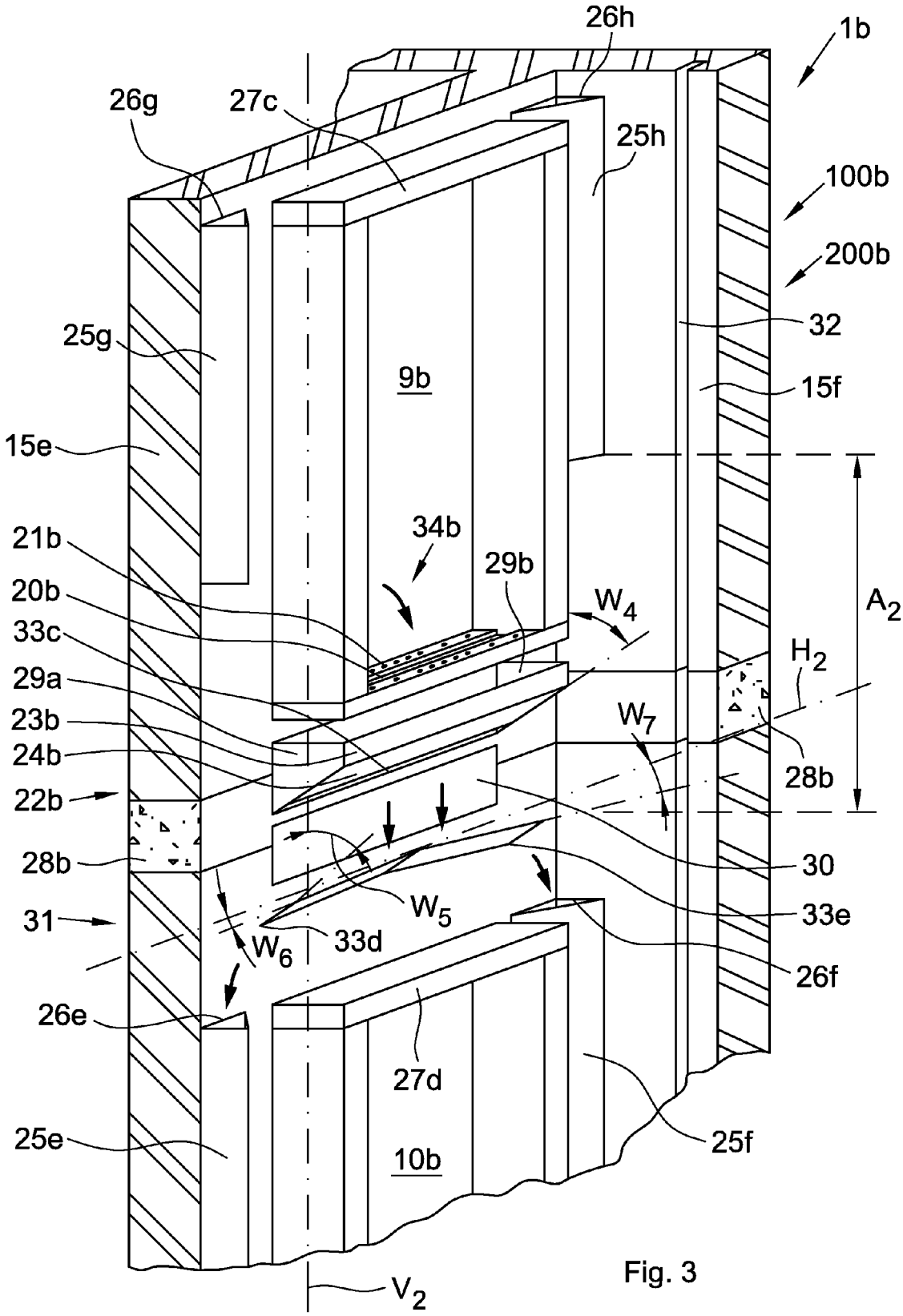
FIG. 3 shows a schematic illustration of a second variant of embodiment of an exemplifying elevator shaft or an exemplifying elevator installation with a further extinguishing water drain system according to the invention at the shaft side.

A variant of embodiment of an exemplifying elevator shaft 1*b* or an exemplifying elevator installation 100*b* is schematically illustrated in FIG. 3. Analogously to FIG. 2, a shaft door 9*b* with a door lintel 27*c* and a shaft door sill 20*b* with passage openings or recesses or bores 21*b* and a further shaft door 10*b* with a door lintel 27*d* are illustrated in a shaft side wall 15*e*. A screed floor 28*b* runs through not only the shaft side wall 15*e*, but also a further shaft side wall 15*f* arranged at approximately a right angle.

A collector plate 22*b* is arranged at the shaft side wall 15*e* below the shaft door sill 20*b*. This collector plate 22*b* is upwardly open and has an approximately perpendicular part surface 23*b* and an inclined part surface 24*b*, which adjoins thereat and which has an angle of inclination $W_4$ to a vertical $V_2$. The collector plate 22*b* additionally has side surfaces 29*a* and 29*b*. Arranged below the collector plate 22*b*, similarly at the shaft side wall 15*e*, is an outflow plate 30 which improves the outflow of extinguishing water 34*b* which has penetrated through the shaft door sill 20*b* and which is collected by the collector plate 22*b* and due to the side surfaces 29*a* and 29*b* is conducted onward exclusively centrally through a gap-shaped outflow opening 33*c* between the inclined part surface 24*b* and the shaft side wall 15*e*.

The outflow plate 30 can also be larger than illustrated or connected with the inclined part surface 24*b* and a drain plate 31 arranged below the outflow plate 30. This drain plate 31 has an angle of inclination $W_5$ to the vertical $V_2$ and is additionally inclined downwardly from approximately the center in mirror image with respect to the sides respectively at an angle of inclination $W_6$ or $W_7$ to a horizontal $H_2$ and thus conducts the extinguishing water 34*b*, which flows away from the outflow plate 30, through respective outflow openings 33*d* and 33*e* into a receiving opening 26*e* of a collector section 25*e* or a receiving opening 26*f* of a collector section 25*f*.

Again, for clarification of an open extinguishing water drain system 200*b* it is illustrated that further collector sections 25*g* and 25*h* with respective receiving openings 26*g* and 26*h* are arranged at a spacing $A_2$ in the corners of the elevator shaft 1*b* above the collector sections 25*e* and 25*f*. Moreover, the elevator shaft 1*b* has in the shaft side wall 15*f* a vertically extending slot 32, into which a car drain plate, which is arranged approximately perpendicularly at the elevator car, can run in recessed manner as spray protection.

Figure 4:
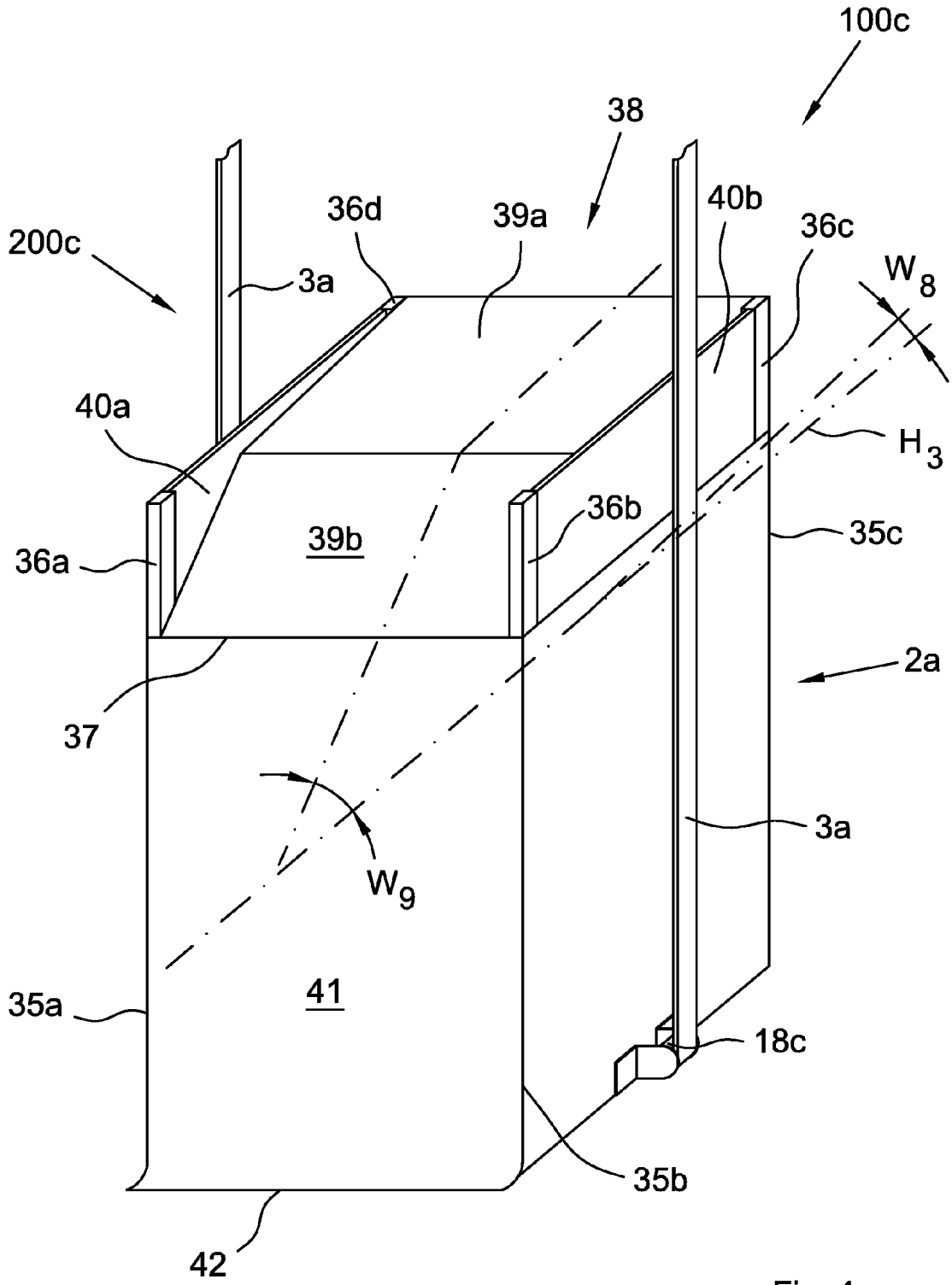
FIG. 4 shows a schematic illustration of a first variant of embodiment of an exemplifying elevator car with an exemplifying extinguishing water drain system at the car side.

FIG. 4 schematically shows an exemplifying elevator car 2*a* which is a component of an exemplifying elevator installation 100*c*. The elevator car 2*a* is carried by a supporting and driving means 3*a* which is guided by deflecting or support rollers 18*c* and 18*d*, of which in the depicted perspective illustration only the deflecting or support roller 18*c* is visible. The block-shaped body of the elevator car 2*a* has four fastening struts 36*a*-36*d* in prolongation of four approximately vertical corner edges 35*a*-35*d* (of which, due to the perspective view, merely the corner edges 35*a*-35*c* are visible).

Fastened to these four fastening struts 36*a*-36*d* and flush with an upper edge 37 of the elevator car 2*a* is rigid and inclined drain plate 38 which forms a first drain surface 39*a* with an approximate angle of inclination $W_8$ of 30 degrees to a horizontal $H_3$ and a second drain surface 39*b* with an angle of inclination $W_9$ of approximately 60 degrees to the horizontal $H_3$. A respective approximately vertically extending connecting plate 40*a* or 40*b* is connected with the drain surface 39*a* or 39*b* or the fastening struts 36*a* and 36*d* or 36*b* and 36*c*.

Extinguishing water which has impinged on the drain surfaces 39*a* and 39*b* is thus collected and flows down a side surface 41 of the elevator car 2*a* and is deflected by an optional lip 42. The drain surfaces 39*a* and 39*b*, the connecting plates 40*a* and 40*b*, the side surface 41 and the lip 42 thus form a first exemplifying elevator car drain system 200*c*.

Figure 5:
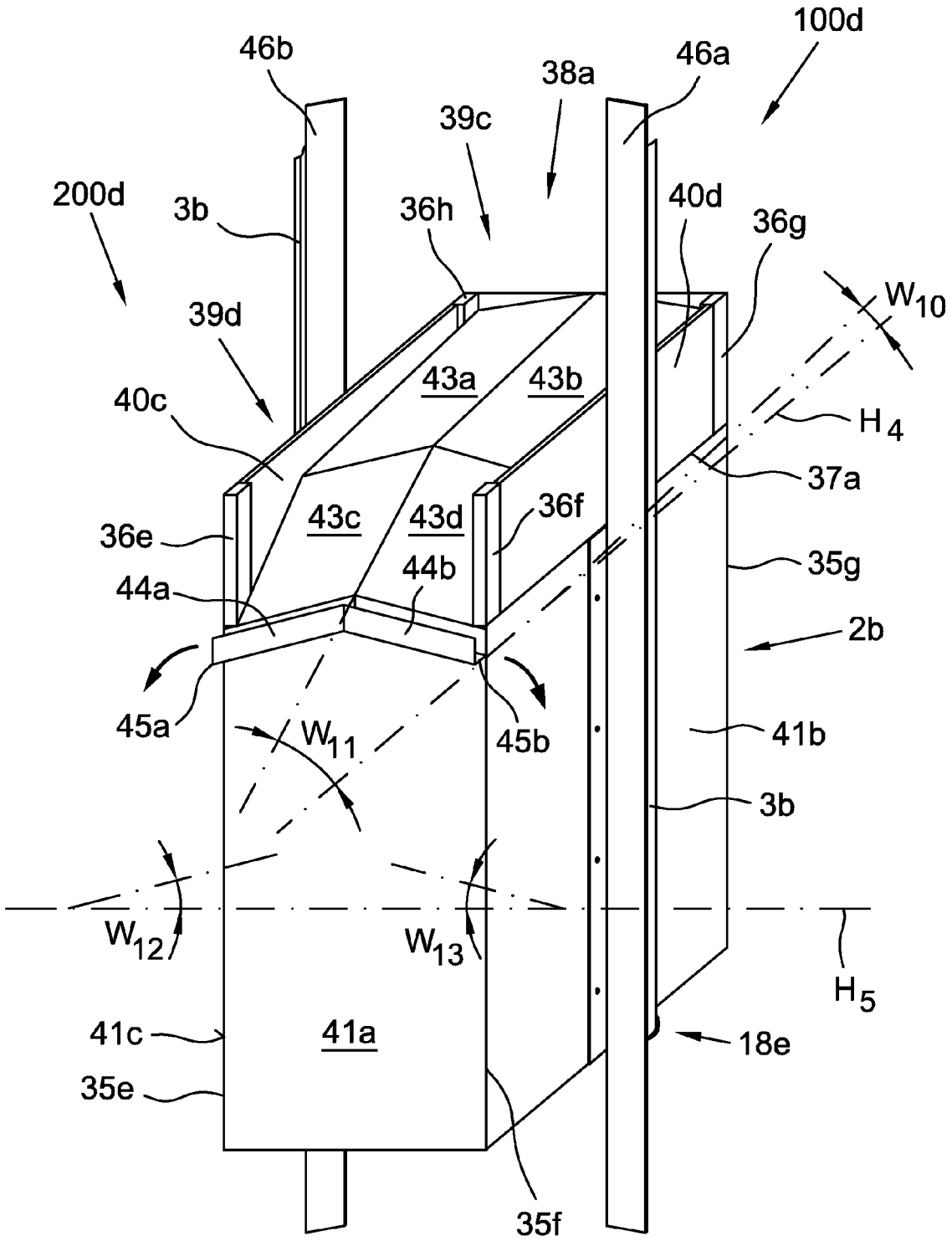
FIG. 5 shows a schematic illustration of a second variant of embodiment of an exemplifying elevator car with an exemplifying extinguishing water drain system at the car side.

A variant of embodiment of an exemplifying elevator car 2*b* or an exemplifying elevator installation 100*d* is schematically illustrated in FIG. 5. The elevator car 2*b*, supported at a visible deflecting or support roller 18*e* and at a concealed deflecting or support roller 18*f* by a supporting and driving means 3*b*, has between a corner edge 35*e* and a further corner edge 35*f* a side surface 41*a*, between the corner edge 35*f* and a further corner edge 35*g* a further side surface 41*b* and between the corner edge 35*e* and a corner edge 35*h*, which is not visible in the illustrated perspective view, a further side surface 41*c*. The side surfaces 41*a*, 41*b* and 41*c* form an upper edge 37*a* of the elevator car 2*b*. Arranged at this upper edge 37*a* in prolongation of the corner edges 35*e*-35*h* are fastening struts 36*e*-36*h* at which a drain plate 38*a* and approximately vertical connecting plates 40*c* and 40*d* are fastened.

The drain plate 38*a* is, analogously to the drain plate 38 of FIG. 4, formed from two drain surfaces 39*c* and 39*d*, of which the drain surface 39*c* is arranged inclined at an angle of inclination $W_{10}$ of approximately 30 degrees to a first horizontal $H_4$ and the drain surface 39*d* is arranged inclined at an angle of inclination $W_{11}$ of approximately 60 degrees to this first horizontal $H_4$. The drain surfaces 39*c* and 39*d* again respectively form two part surfaces 43*a* and 43*b* or 43*c* and 43*d*, which are inclined in mirror image and towards the upper edge 37*a* at a respective angle of inclination $W_{12}$ and $W_{13}$ of approximately 30 degrees to a second horizontal $H_6$.

Two channels 44*a* and 44*b* each with a respective outflow or discharge 45*a* or 45*b* are arranged at the side surface 41*a* to be flush with respect to the part surfaces 43*c* and 43*d*. In this way the extinguishing water is collected on the roof of the elevator car 2*b*, conducted away to the side surfaces 41*a*-41*c*, collected in the channels 44*a* and 44*b* and delivered via the outflows or discharges 45*a* and 45*b* at the corner edges 35*e* and 36*f* of the elevator car 2*b*.

For further protection of the supporting and driving means 3*b* there is arranged at each of the side surfaces 41*b* and 41*c* in the form of an angle section a respective vertical drain plate 46*a* or 46*b* as spray protection, which can run in recessed manner in the slot 32 of FIG. 3.

The illustrated drain plate 38*a*, the approximately vertical connecting plates 40*c* and 40*d*, the channels 44*a* and 44*b* as well as the vertical drain plates 46*a* and 46*b* form a second variant of embodiment of an elevator car drain system 200*d* at the elevator car 2*b* or in the elevator installation 100*d*.

It is possible as an optional variant of embodiment to arrange the outflows or discharges 45*a* and 45*b* by means of two connecting pipes at the lower edge of the elevator car 2*b* and in addition optionally feed the extinguishing water, which collects at the vertical drain plates 46*a* and 46*b*, to these outflows or discharges 45*a* and 45*b* arranged at the lower edge.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A drain system in an elevator installation having an elevator shaft comprising: the drain system being an open system with a collector plate wherein extinguishing water that penetrates through a shaft door sill of the elevator shaft equipped with passage openings impinges on the collector plate arranged adjacent to and below the shaft door sill and is conducted away via a gap-shaped outflow opening of the collector plate substantially downwardly along at least one shaft wall of the elevator shaft, wherein the collector plate has an inclined surface extending outwardly and upwardly from the at least one shaft wall at an angle of inclination to a vertical of the elevator shaft, the gap-shaped outflow opening disposed between the inclined surface and the at least one shaft wall.

2. The drain system according to claim 1 wherein the extinguishing water is fed via the outflow openings to receiving openings of collector sections arranged at a spacing in a vertical of the elevator shaft.

3. The drain system according to claim 2 wherein the collector sections are triangular shaped sections.

4. The drain system according to claim 2 wherein the collector sections have a receiving opening widened in a funnel shape.

5. An elevator installation with a drain system according to claim 1.

6. A drain system in an elevator installation having an elevator shaft comprising: the drain system being an open system with a collector plate wherein extinguishing water that penetrates through a shaft door sill of the elevator shaft equipped with passage openings impinges on the collector plate arranged adjacent to and below the shaft door sill and is conducted away via a central outflow opening of the collector plate substantially downwardly along at least one shaft wall of the elevator shaft, wherein the collector plate has an inclined surface extending outwardly and upwardly from the at least one shaft wall at an angle of inclination to a vertical of the elevator shaft, wherein the extinguishing water is fed through the central outflow opening of the collector plate substantially to a drain plate in the elevator shaft and is conducted away via outflow openings of the drain plate substantially along the at least one shaft wall.

7. The drain system according to claim 6 wherein the drain plate has at least one inclined surface arranged at an angle of inclination to a vertical of the elevator shaft.

8. The drain system according to claim 6 wherein the drain plate has at least two surfaces arranged in mirror image at an angle of inclination to a horizontal of the elevator shaft.

9. The drain system according to claim 6 wherein the drain plate is arranged above a door lintel in the at least one shaft wall of the elevator shaft.

10. The drain system according to claim 6 wherein a planar outflow plate is arranged between the collector plate and the drain plate.

11. A method of draining extinguishing water in an elevator installation with a drain system, comprising the following steps:

a) conducting the extinguishing water through a shaft door sill with bores into an elevator shaft;

b) collecting the extinguishing water with a collector plate in the elevator shaft arranged adjacent to and below the door sill with at least one part surface inclined outwardly and upwardly from a shaft wall at an angle of inclination to a vertical of the elevator shaft;

c) passing on the extinguishing water to a gap-shaped outflow opening of the collector plate the gap-shaped outflow opening disposed between the surface inclined outwardly and upwardly from the shaft wall and the shaft wall; and d) conducting away the extinguishing water from the outflow opening substantially downwardly along the shaft wall of the elevator shaft.

* * * * *